US006563268B2

(12) United States Patent
Yoshida et al.

(10) Patent No.: US 6,563,268 B2
(45) Date of Patent: May 13, 2003

(54) HIGH-INTENSITY DISCHARGE LAMP

(75) Inventors: Masahito Yoshida, Osaka (JP); Kenji Akiyoshi, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 10/036,774

(22) Filed: Dec. 20, 2001

(65) Prior Publication Data

US 2002/0101165 A1 Aug. 1, 2002

(30) Foreign Application Priority Data

Dec. 22, 2000 (JP) ..... 2000-390089

(51) Int. Cl.[7] ..... H01J 7/44
(52) U.S. Cl. ..... 315/73; 315/58
(58) Field of Search ..... 315/73, 58, 59, 315/46, 240, 241 R, 243, 289, 290, 309

(56) References Cited

U.S. PATENT DOCUMENTS

| | | | | |
|---|---|---|---|---|
| 2,379,115 A | | 6/1945 | Thayer | 315/100 |
| 2,464,748 A | | 3/1949 | Hodgkins | 315/100 |
| 4,137,483 A | * | 1/1979 | Ochi et al. | 315/74 |
| 5,389,856 A | * | 2/1995 | Luijks et al. | 315/58 |
| 5,420,479 A | * | 5/1995 | Iida et al. | 315/73 |

FOREIGN PATENT DOCUMENTS

| | | | |
|---|---|---|---|
| EP | 0 009 970 | 4/1980 | H01J/61/54 |
| EP | 0 038 035 | 10/1981 | H01J/17/34 |
| EP | 0 204 382 | 12/1986 | H01J/61/28 |
| EP | 0 565 113 | 10/1993 | H01J/61/56 |
| JP | 55-6729 | 1/1980 | H01J/61/56 |
| JP | 7-105913 | 4/1995 | H01J/61/54 |
| JP | 9-63541 | 3/1997 | H01J/61/54 |
| JP | 10-284006 | 10/1998 | H01J/61/54 |
| WO | WO99/55123 | 10/1999 | H05B/41/08 |

* cited by examiner

*Primary Examiner*—Hoang Nguyen
(74) *Attorney, Agent, or Firm*—Merchant & Gould P.C.

(57) ABSTRACT

A high-intensity discharge lamp includes an arc tube having a pair of main electrodes, a starting circuit having a thermally-actuated switch for disconnecting the starting circuit, and an outer tube for containing the arc tube and the starting circuit, and the lamp is lighted by means of a reactance ballast. The thermally-actuated switch includes an envelope bulb that covers contacts of the thermally-actuated switch. Thereby, occurrence of sustained arc discharge in the outer tube is prevented in the case of a starting failure or a break-off of the arc tube at the end of the lamp's life.

6 Claims, 8 Drawing Sheets

HIGH-INTENSITY DISCHARGE LAMP

FIELD OF THE INVENTION

The present invention relates to a high-intensity discharge lamp with a built-in starter.

BACKGROUND OF THE INVENTION

In this energy-saving era, as high-intensity discharge lamps for outdoor use such as in streets, public squares, avenues, or for indoor use such as in factories, sports arenas, and shops, metal halide lamps and high-intensity sodium lamps are used because they are more efficient and provide better color rendering in a comparison with conventionally-used high-intensity mercury lamps.

Since these metal halide lamps and high-intensity sodium lamps are applied in general to conventional facilities that have been used for conventional high-intensity mercury lamps, the lighting requires a simple copper-iron type reactance ballast based on the power supply frequency. Therefore, for the purpose of lighting by means of the copper-iron type reactance ballasts, these lamps contain starting circuits that are not provided for conventional high-intensity mercury lamps.

Various types of starting circuits have been used depending on the lamps, which are classified in general into the following two basic types.

An example of a first basic type is shown as a starting circuit 57 in FIG. 6. The circuit has a basic structure of a series circuit comprising a switching element 58 for interrupting current, a resistor 59 for restricting current, and a thermally-actuated switch 60 composed of a bimetal for disconnecting the starting circuit. This series circuit is connected in parallel to an arc tube 63 comprising at both the terminals a pair of main electrodes 61 and 62.

The aforementioned starting circuit 57 and the arc tube 63 are arranged inside a glass outer tube 65 that is under vacuum or filled with a gas so as to compose a lamp 64. The switching element 58 can be, for example, a glow starter for a metal halide lamp, a nonlinear ceramic capacitor or a thermally-actuated switch of a bimetal for a high-intensity sodium lamp. The thermally-actuated switch functions also for disconnecting the starting circuit.

The bimetal thermally-actuated switch 60 for disconnecting the starting circuit, as shown in FIG. 7, comprises a lead 66 as a fixed contact, an insulating glass 67, a supporter 68 as a L-shaped fixed electrode member, a contact rod 69 as a movable contact, and a bimetal plate 70 as a movable electrode member. The lead 66 is connected at one terminal to the electrode 61 and connected at the other terminal to the insulating glass 67. The supporter 68 is connected at one terminal to the insulating glass 67 and connected at the other terminal to the resistor 59. The bimetal plate 70 is provided with the contact rod 69 at the front end portion while the back end portion is attached to the supporter 68. The contact rod 69 contacts with and/or separates from the lead 66 due to slow turn-over operation of the bimetal plate 70 caused by heat. A portion that the fixed contact of the thermally-actuated switch 60 contacts with the movable contact, i.e., a contact between the lead 66 and the contact rod 69, is positioned to be exposed to the interior of the outer tube 65.

The starting circuit 57 operates in the following manner. When the switching element 58 repeats on-off operation by application of a supply voltage 22, a high voltage pulse ranging from 1 kV to 4 kV is induced at a reactance ballast 21 due to interruption of current at every time of on-off operation, thereby causing the arc tube 63 to start discharging. Subsequently, the on-off operation of the switching element 58 stops just after the discharging starts. About two to three minutes after the start of the discharging, the thermally-actuated switch 60 shifts slowly from a closed state to an open state by the heat from the arc tube 63, and thus, the starting circuit 57 is disconnected from a lighting circuit. Subsequently, the thermally-actuated switch 60 maintains its open state during the steady lighting state of the lamp.

Regarding the starting circuit 57 in FIG. 6, a typical metal halide lamp using a glow starter for the switching element 58 is provided with a resistor 59 arranged in the vicinity of the thermally-actuated switch 60, so that the thermally-actuated switch 60 shifts from a closed state to an open state due to heat from the resistor 59 so as to stop the switching operation of the glow starter in case of a starting failure of the arc tube.

A second basic type is exemplified as a starting circuit 71 in FIG. 8. Such a circuit is used particularly for a metal halide lamp 76 using a quartz arc tube 75 comprising an auxiliary electrode 74 as well as a pair of main electrodes 72, 73. This starting circuit 71 comprises a series circuit including a resistor 77 for restricting current and a thermally-actuated switch 78 of a bimetal for disconnecting the starting circuit. The starting circuit 71 is connected at one terminal to the main electrode 72 and to the auxiliary electrode 74 at the other terminal. Also for this thermally-actuated switch 78, the contact is positioned to be exposed to the interior of the outer tube 79.

The starting circuit 71 operates as follows. When a supply voltage 22 is applied, auxiliary discharge occurs first between the main electrode 73 and the auxiliary electrode 74. Next, due to the action of initial electrons sufficiently supplied from the auxiliary discharge, main discharge starts between the main electrodes 72 and 73. About two minutes after the start of the main discharge, the thermally-actuated switch 78 shifts slowly from a closed state to an open state by heat from the arc tube 75, and the starting circuit 71 is disconnected from the lighting circuit. Subsequently, the thermally-actuated switch 78 maintains its open state during the steady lighting state of the lamp.

Some kinds of metal halide lamps use the above-mentioned two basic types of starting units together.

However, it has been known through a long-time use on the market that in the metal halide lamps and the high-intensity sodium lamps containing such conventional starting circuits, especially the above-mentioned two basic types of starting circuits, problems will be caused in connection with thermally-actuated switches for a basic components of such lamps, which are used for disconnecting starting circuits.

As mentioned above, the thermally-actuated switch 60 or 78 comprising a bimetal used for such a conventional starting circuit 57 or 71 has exposed contacts, since such a structure is cost-effective and problems like oxidation are not caused as the contacts are housed in an outer tube.

In a lamp using such a thermally-actuated switch 60 or 78, especially when the arc tube 63 or 75 fails to start or it ceases its lighting at the end of life etc. due to rise in the lamp voltage, arc discharge can occur, even though the possibility is low, at a contact of the thermally-actuated switch 60 or 78 in an OFF state, i.e., an open state. This is caused by a high voltage pulse induced at the reactance ballast 21 due to current interruption. Here, the problem is that the initial electrons supplied from the arc discharge at the contact can induce sustained occurrence of further arc discharge between a pair of leads that hold the arc tube. Because of the sustained arc discharge, excessive lamp short-circuit current may run continuously in the reactance ballast 21. Moreover, terminals of the outer tube 65 or 79 facing a lamp base may be damaged although the possibility is low as well.

While an outer tube of a typical high-intensity sodium lamp is in a vacuum state as mentioned above, materials such as sodium as a luminescent material and a xenon gas for a starting aid may leak from the interior of the arc tube at the end of the lamp life. Experimental results show that this causes the above-mentioned sustained arc discharge. Arc discharge can occur at the contact of the thermally-actuated switch 78 of the second type starting circuit especially when the arc tube breaks off. The reason is considered as follows. Since a conducting state between the main electrodes and the adjacent auxiliary electrode is maintained just after the arc tube breaks off, a high voltage pulse induced due to the interruption of the lamp current will be applied directly to the disconnected contact of the thermally-actuated switch.

Occurrence of excessive lamp short-circuit current, damage in an outer tube caused by arc discharge sustained inside the outer tube or the like, should be avoided from an aspect of safety for a high-intensity discharge lamp that comprises a movable electrode member of a bimetal and contains a starting circuit using a slow-action type thermally-actuated switch that turns over slowly when the temperature reaches a predetermined level. Secure solutions of such problems require the prevention of occurrence of sustained arc discharge induced by arc discharge at a contact of a thermally-actuated switch.

SUMMARY OF THE INVENTION

The present invention provides a high-intensity discharge lamp with high safety, suppressing inducement of sustained arc discharge inside an outer tube caused by arc discharge at a contact of a thermally-actuated switch when an arc tube fails to start or breaks off at the end of the lamp's life or the like.

A high-intensity discharge lamp according to the present invention contains a starter, i.e., the lamp comprises an arc tube having a pair of main electrodes, a starting circuit having a thermally-actuated switch for disconnecting the starting circuit, and an outer tube containing the arc tube and the starting circuit, where the lamp is lighted up by means of a reactance ballast. The thermally-actuated switch comprises an envelope bulb that covers contacts of the thermally-actuated switch.

The structure can prevent the occurrence of sustained arc discharge in the outer tube, which is induced by arc discharge between contacts of the thermally-actuated switch when the arc tube fails to start or breaks off at the end of the lamp's life.

It is preferable that the thermally-actuated switch is a snap-action type thermally-actuated switch.

It is also preferable for the thermally-actuated switch that a spacing between contacts in an open state is at least 0.3 mm.

In the above-mentioned structure, the arc tube has an auxiliary electrode, while the starting circuit comprises a series circuit of a glow starter, a first resistor, and the thermally-actuated switch, and the series circuit is connected in parallel to the arc tube, and a second resistor having one terminal connected to a node between the thermally-actuated switch and the first resistor and the other terminal connected to the auxiliary electrode, where the first resistor and the thermally-actuated switch are arranged adjacent to each other.

An alternative structure comprises a start-aiding conductor that is arranged to be supplied with voltage via a capacitor along with an axial direction of the arc tube, and the starting circuit comprises a series circuit of nonlinear ceramic capacitor having a switching function to interrupt current, a tungsten filament resistor for restricting current, and the thermally-actuated switch, and the series circuit is connected in parallel to the arc tube, and a heating resistor that is connected in parallel to the tungsten filament resistor and to the nonlinear ceramic capacitor and arranged in the vicinity of the nonlinear ceramic capacitor.

Alternatively, the arc tube can comprise an auxiliary electrode, and the starting circuit can comprise a series circuit of a resistor and the thermally-actuated switch, and a terminal of the thermally-actuated switch that is not connected to the resistor is connected to a main electrode while a terminal of the resistor that is not connected to the thermally-actuated switch is connected to the auxiliary electrode.

DETAILED DESCRIPTION OF THE INVENTION (First Embodiment)

Figure 1:
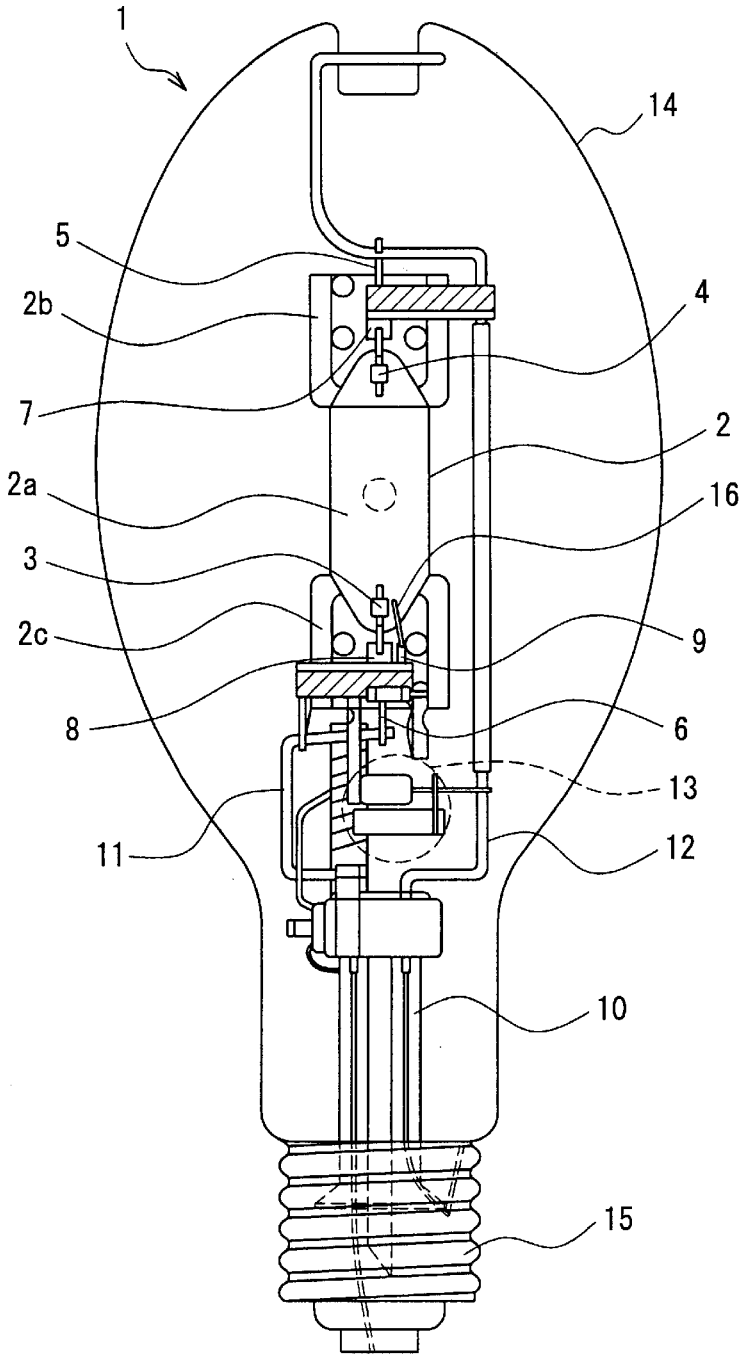
FIG. 1 is a front view illustrating a metal halide lamp in a first embodiment of the present invention.

FIG. 1 illustrates a metal halide lamp with a built-in starter according to a first embodiment of the present invention. A metal halide lamp 1 comprises a quartz arc tube 2 comprising a light-emitting portion 2*a* having a discharge space and sealed portions 2*b*, 2*c* formed at both ends of the light-emitting portion 2*a*. At the sealed portions 2*b*, 2*c*, molybdenum foils 7, 8 as metal foils are sealed respectively, and main electrodes 3, 4 and outer leads 5, 6 are connected to the molybdenum foils 7, 8. Similarly, an auxiliary electrode 16 is sealed adjacent to the main electrode 3 via a molybdenum foil 9. The main electrodes 3, 4 are positioned respectively at both end portions inside the light-emitting portion 2*a*. In the arc tube 2, a metal halide ($NaI+ScI_3$) as a luminescent material, mercury (Hg) as a buffer gas, and argon (Ar) as a start-aiding gas are filled. An example of a specific dimension of the arc tube 2 is, for example, 20 mm in the inner diameter of the arc tube and 42.5 mm in Le (a distance between main electrodes) for a 400 W type.

A glass outer tube 14 is sealed with a glass stem 10, and inside the outer tube 14, the arc tube 2 and a starting circuit 13 are housed, where the arc tube 2 is connected to and held by to leads 11, 12 extending from the glass stem 10. A gas based on nitrogen at a pressure of about 46.5 kPa is filled in the outer tube 14. A lamp base 15 is attached to the outer tube 14 at the end portion facing the glass stem 10.

Figure 2:
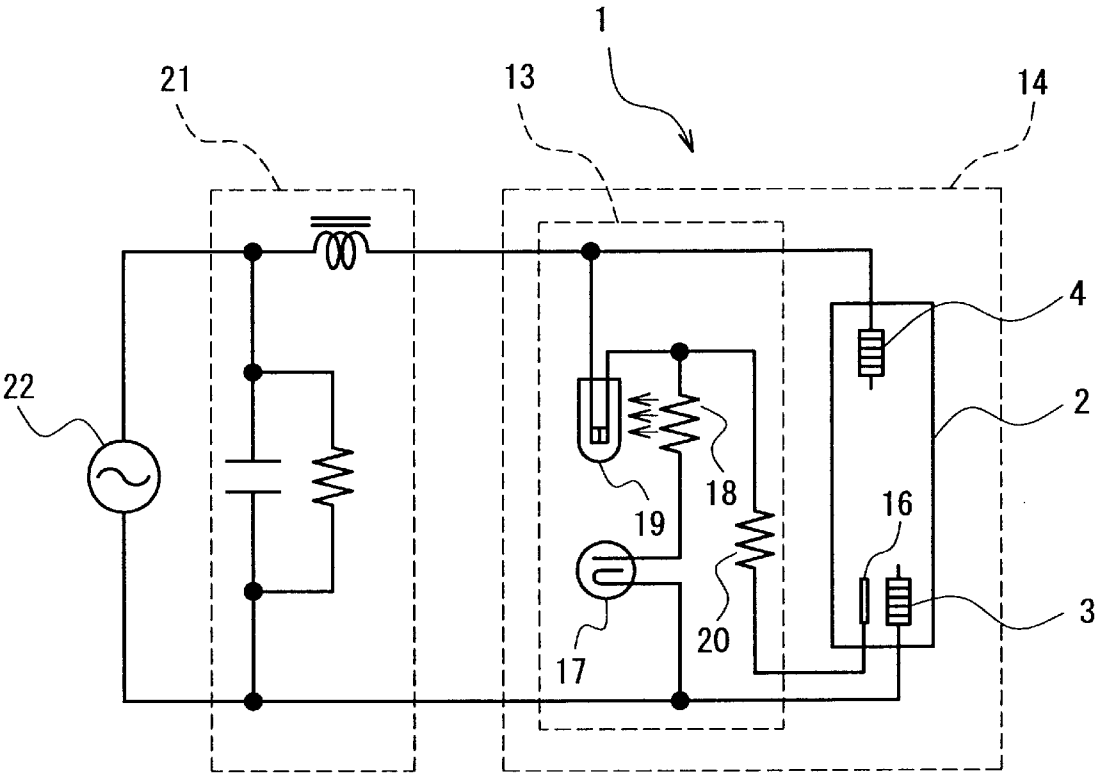
FIG. 2 is a diagram illustrating a lighting circuit of the metal halide lamp.

As shown in FIG. 2, the starting circuit 13 comprises a series circuit comprising a glow starter 17 for interrupting current, a first resistor 18 for restricting current, and a thermally-actuated switch 19 for disconnecting the starting circuit. The series circuit is connected in parallel to the arc tube 2. The starting circuit 13 further comprises a second resistor 20. The second resistor 20 has one end connected to a node between the thermally-actuated switch 19 and the first resistor 18, while the other end is connected to the auxiliary electrode 16.

The first resistor 18 and the thermally-actuated switch 19 are positioned adjacent to each other in order to keep the thermally-actuated switch 19 in an open state due to the heat of the first resistor 18 so as to interrupt current in the case of a starting failure of the arc tube 2, and thereby stop the switching operation of the glow starter 17.

This metal halide lamp 1 is attached to a fixture (not shown) and supplied with a supply voltage 22 via the reactance ballast 21 while being used.

An explanation about lighting the metal halide lamp 1 follows.

During a steady lighting operation of the metal halide lamp 1, auxiliary discharge occurs between the main electrode 3 and the auxiliary electrode 16 by an application of the supply voltage 22 so as to supply initial electrons while the glow starter 17 operates so that on-off operation of the electrode contacts inside the glow starter 17 is repeated. At this time, current flowing in the reactance ballast 21 is interrupted at every on-off operation so as to induce a high voltage pulse ranging from 1.5 kV to 2.0 kV, and thus, discharging starts between the main electrodes 3 and 4 of the arc tube 2 due to the action of the initial electrons and application of the high voltage pulse. Once the discharging starts, the glow starter 17 shifts to a non-operative condition. About two minutes after the starting, the thermally-actuated switch 19 shifts from a closed state to an open state due to the heat from the arc tube 2, and the starting circuit 13 is disconnected (separated) from the lighting circuit. Subsequently, the thermally-actuated switch 19 maintains an open state during a steady lighting state of the lamp due to the heat from the arc tube 2.

When the arc tube 2 is not lighted in a steady manner for some reasons, the thermally-actuated switch 19 shifts from a closed state to an open state by heat from the first resistor 18 and the starting circuit 13 is disconnected from the lighting circuit, so that safety of the circuit is maintained.

Figure 3:
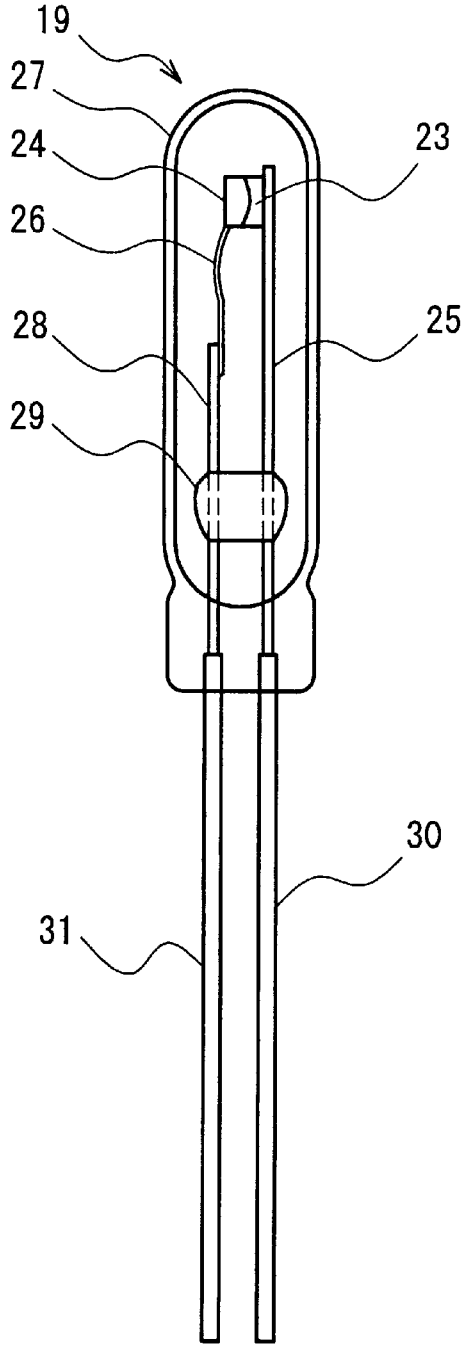
FIG. 3 illustrates a thermally-actuated switch used for the lighting circuit.

A thermally-actuated switch 19 composing the metal halide lamp in this embodiment is a snap-action type that will turn over instantaneously when a temperature reaches a predetermined level. As shown in FIG. 3, the thermally-actuated switch 19 comprises a fixed electrode member 25 and a movable electrode member 26 having contacts 23, 24 welded respectively at the tips, both of which are arranged inside a glass envelope bulb 27 filled with air at a pressure of about 67 kPa. The contacts 23 and 24 may be made of Ag-coated Cu—Ni. The fixed electrode member 25 is made of a Ni—Cr—Fe plate, while the movable electrode member 26 is made of a Fe—Ni/Fe—Ni—Cr bimetal plate. The movable electrode member 26 is formed by a so-called punching method, and processed to perform snap-action instantaneously when applied with heat.

The movable electrode member 26 is supported by a movable electrode supporter 28. The fixed electrode member 25 and the movable electrode supporter 28 are fixed with a glass bead 29, and welded respectively to outer leads 30 and 31. The outer leads 30, 31 are sealed at an end of a glass envelope bulb 27.

The thermally-actuated switch 19 in the metal halide lamp 1 operates in the following manner. First, the closed state shifts to an open state instantaneously, e.g. in as short a time as about 500 ns, by a snap-action when the temperature of the movable electrode member 26 reaches a determined level, for example about 120° C. At this time, a spacing between the contacts 23 and 24 in an open state may be about 0.6 mm. Subsequently in the steady lighting state of the lamp, the spacing between the contacts 23 and 24 may increase up to about 1.5 mm due to the heat from the arc tube 2. Also, at a failure of the arc tube just after the starting, e.g., a break-off, the contacts 23 and 24 of the thermally-actuated switch 19 separate from each other instantaneously, for example with a spacing of about 0.6 mm. No arc discharge between the contacts 23, 24 of the thermally-actuated switch 19 was recognized. This was confirmed in a test carried out by the inventor, i.e., application of a high voltage pulse of 4 kV at most.

For the metal halide lamp of this embodiment, the spacing between the contacts of the thermally-actuated switch 19 may increase further to about 4 mm at most due to the heat from the arc tube 2 even after an open state was obtained. The movable electrode member 26 of the thermally-actuated switch 19 may be designed to shift from an open state to a closed state when the temperature is lowered to about 80° C., and at the same time the contacts 23, 24 are closed instantaneously from an open state with a spacing of about 0.6 mm.

As mentioned above, the metal halide lamp of the embodiment differs from a conventional high-intensity discharge lamp with a built-in starter in that the contacts of the thermally-actuated switch 19 are not exposed to the interior of the outer tube 14 while contacts of a thermally-actuated switch in such a conventional lamp are positioned to be exposed to the interior of its outer tube. Thereby, the metal halide lamp of the present invention can avoid the problem of the conventional high-intensity discharge lamp with a built-in starter in which arc discharge occurs between the contacts of the thermally-actuated switch, which is caused by the high voltage pulse induced at the reactance ballast 21 due to current interruption at a starting failure of the arc tube 2 at the end of the lamp's life, or at a break-off caused by voltage rise of the lamp just after the starting. Furthermore, the metal halide lamp of the embodiment can prevent the arc discharge from causing the further arc discharge that may occur between the leads 11 and 12 or the like so as to prevent excessive lamp short-circuit current from flowing into the lighting circuit or the arc discharge from moving to a region near the glass stem to damage the outer tube.

Regarding a conventional high-intensity discharge lamp with a built-in starter, it was found that arc discharge occurs only when a spacing between the contacts of the thermally-actuated switch in an open state, i.e., OFF state, is less than 0.3 mm. The reason is that the contacts of the thermally-actuated switch become a region with a lowest discharge impedance in the lighting circuit and easily start discharging when the spacing between contacts is less than 0.3 mm. Therefore, it is preferable that the spacing is 0.3 mm or more. It is more preferable that the spacing is 0.6 mm or more.

Considering the above-mentioned facts, this embodiment can provide a metal halide lamp with a doubled safety since a spacing between contacts of the thermally-actuated switch 19 in an open state is more than 0.3 mm, and the thermally-actuated switch 19 is covered with an envelope bulb 27.

(Second Embodiment)

Figure 4:
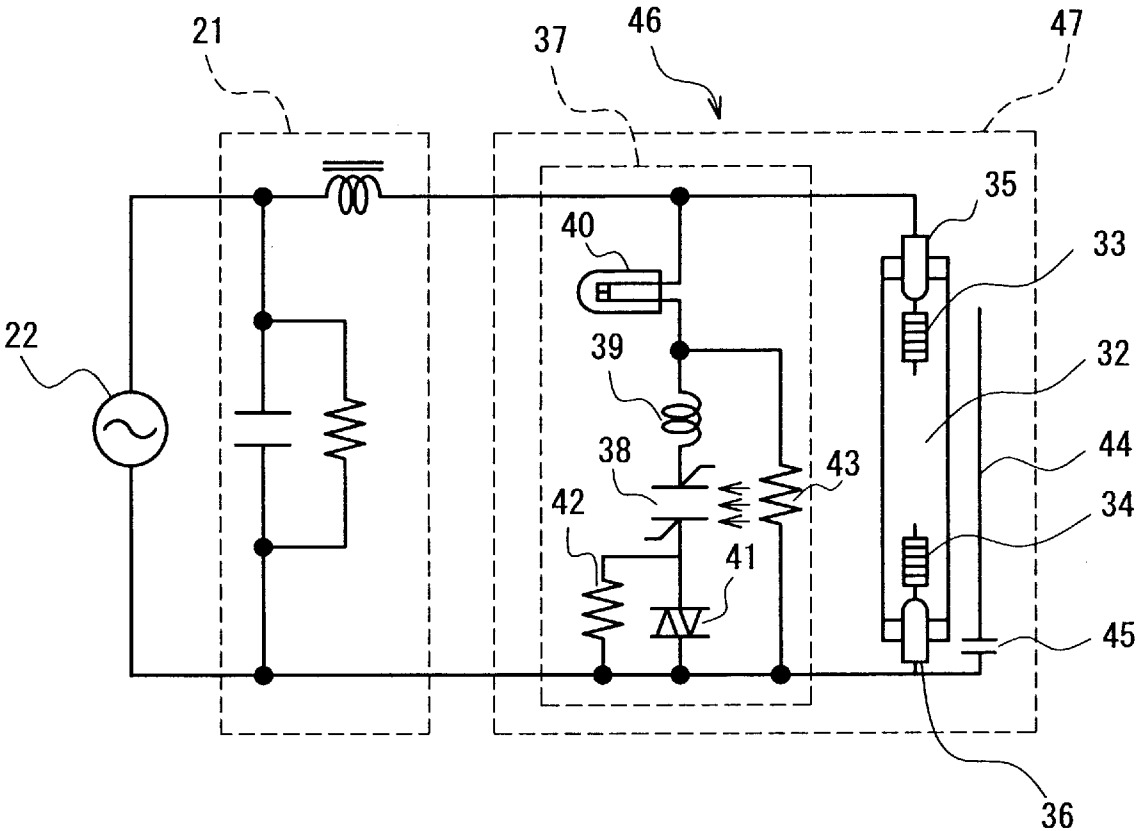
FIG. 4 is a diagram illustrating a lighting circuit of a high-intensity sodium lamp in a second embodiment of the present invention.

A high-intensity sodium lamp with a built-in starter in a second embodiment of the present invention is described below referring to FIG. 4. An arc tube 32 composing a high-intensity sodium lamp 46 comprises a polycrystalline alumina ceramic tube. At both the end portions, niobium tubes 35, 36 holding a pair of tungsten electrodes 33, 34 may be sealed with a ceramic cement. In the arc tube 32, sodium (Na) as a luminescent material and mercury (Hg) as a buffer gas are filled in the form of amalgam, and xenon (Xe) as a start-aiding gas of about 27 kPa is filled as well.

The starting circuit 37 comprises a series circuit comprising a nonlinear ceramic capacitor 38 having a switching function for interrupting current, a tungsten filament resistor 39 for restricting current, and a thermally-actuated switch 40 for disconnecting a starting circuit. This series circuit is connected in parallel to the arc tube 32. The thermally-actuated switch 40 is similar to the thermally-actuated switch 19 used in the first embodiment. For an additional member for the starting circuit 37, a SIDAC (bi-directional thyristor) 41 for inducing a higher voltage pulse is connected in series to the series circuit, i.e., to the nonlinear ceramic capacitor 38, the tungsten filament resistor 39 and to the thermally-actuated switch 40. Additionally, a control resistor 42 for the SIDAC 41 is connected in parallel to the SIDAC 41. Furthermore, a heating resistor 43 is connected in parallel to the tungsten filament resistor 39, the linear ceramic capacitor 38 and the SIDAC semiconductor 41 in order to lower the voltage pulse in case of a starting failure of the arc tube.

A start-aiding conductor 44 of a molybdenum wire is attached via the capacitor 45 along with the axial direction of the arc tube 32. The arc tube 32 and the starting circuit 37 are arranged inside an evacuated outer tube 47.

The high-intensity sodium lamp 46 is lighted in the following manner. When a supply voltage 22 is applied, a high voltage pulse, for example ranging from 2 kV to 3 kV, is induced at the reactance ballast 21 due to the switching function of the nonlinear ceramic capacitor 38. Thereby, the arc tube 32 starts discharging, and after that, the starting circuit 37 becomes non-operative. Next, about two minutes after the starting, the thermally-actuated switch 40 shifts from a closed state to an open state due to the heat from the arc tube 32, and the starting circuit 37 is separated from the lighting circuit. Subsequently, the thermally-actuated switch 40 maintains its open state during a steady lighting state of the lamp due to the heat from the arc tube 32. Similar to the first embodiment, a spacing between the contact of the fixed electrode member and the contact of the movable electrode member was about 0.6 mm when the thermally-actuated switch 40 was in an open state.

In a lighting test for the high-intensity sodium lamp of this embodiment, no arc discharge occurred between the contacts of the thermally-actuated switch 40 in an open state even when a filler gas comprising sodium and xenon etc. was leaked from the arc tube 32 into the outer tube 47 at a break-off just after the starting or at the end of the lamp's life. And thus, it was confirmed that no sustained arc discharge was induced between the remaining leads.

The starting circuit 37 is configured so that the temperature at the nonlinear ceramic capacitor 38 is raised due to the heat from the heating resistor 43 so as to lower the switching function, and thus, the induced voltage pulse is decreased sharply in case of a starting failure of the arc tube 32. And since the thermally-actuated switch 40 is kept in a closed state in such a case of a starting failure of the arc tube, no arc discharge will occur between the contacts.

(Third Embodiment)

Figure 5:
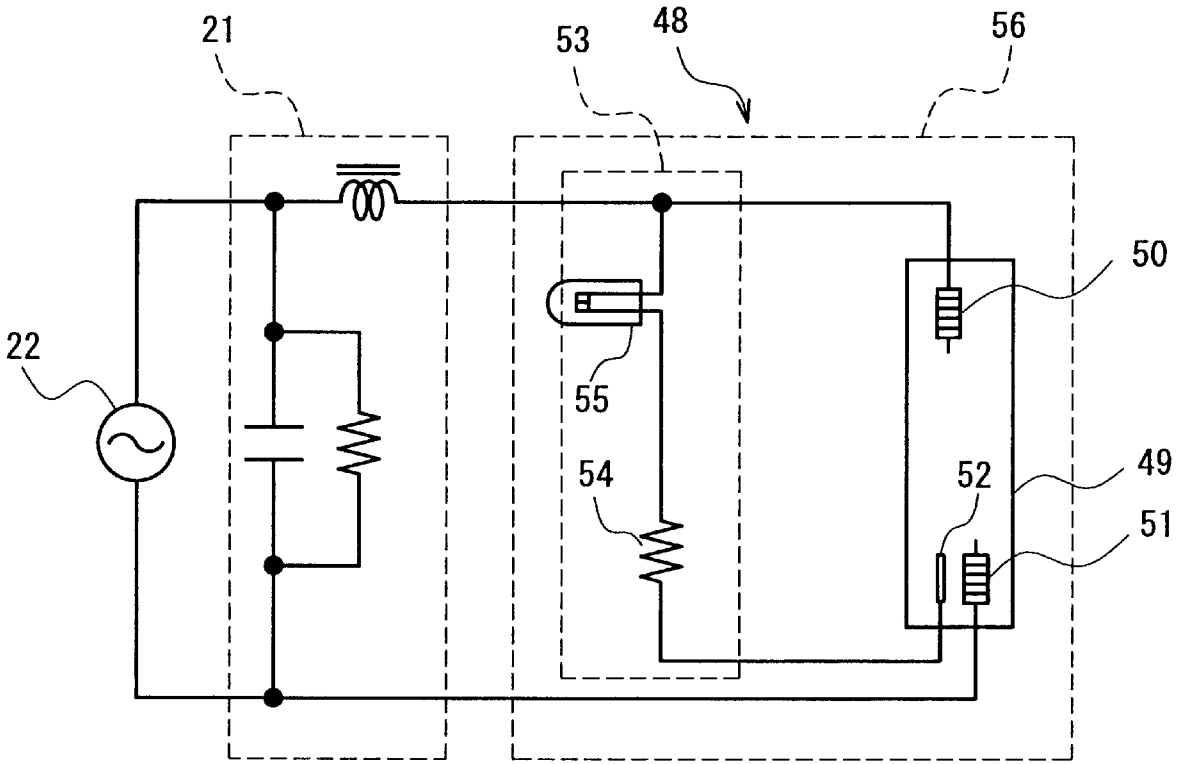
FIG. 5 is a diagram illustrating a lighting circuit of a metal halide lamp in a third embodiment of the present invention.
Figure 6:
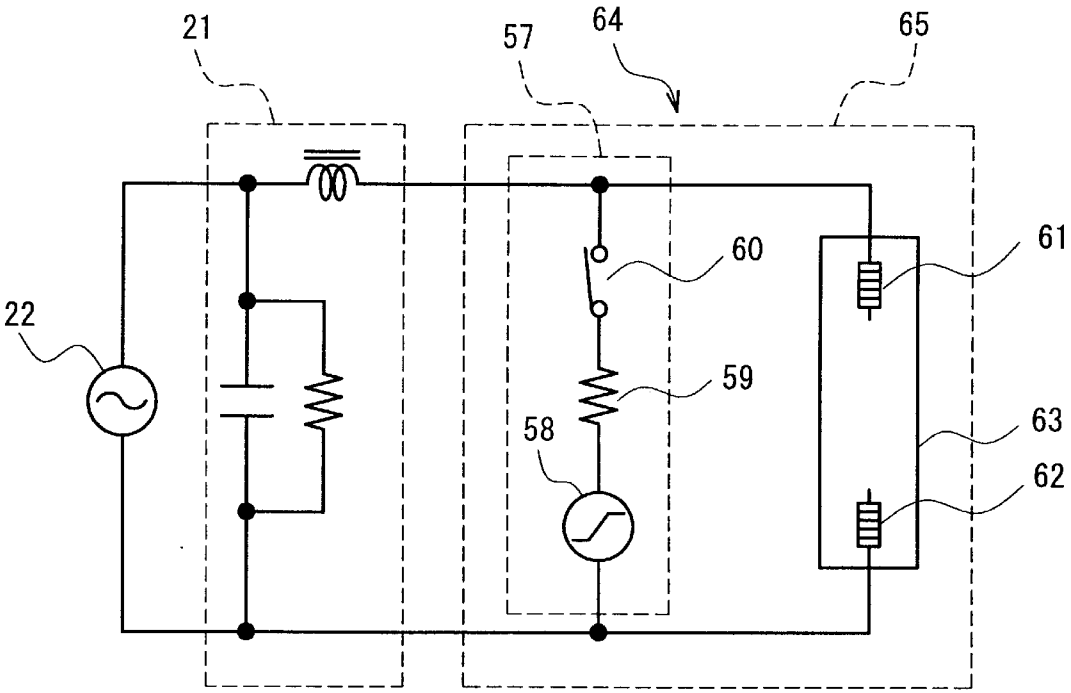
FIG. 6 (PRIOR ART)
FIG. 6 is a diagram illustrating a starting circuit of a conventional high-intensity discharge lamp.
Figure 7:
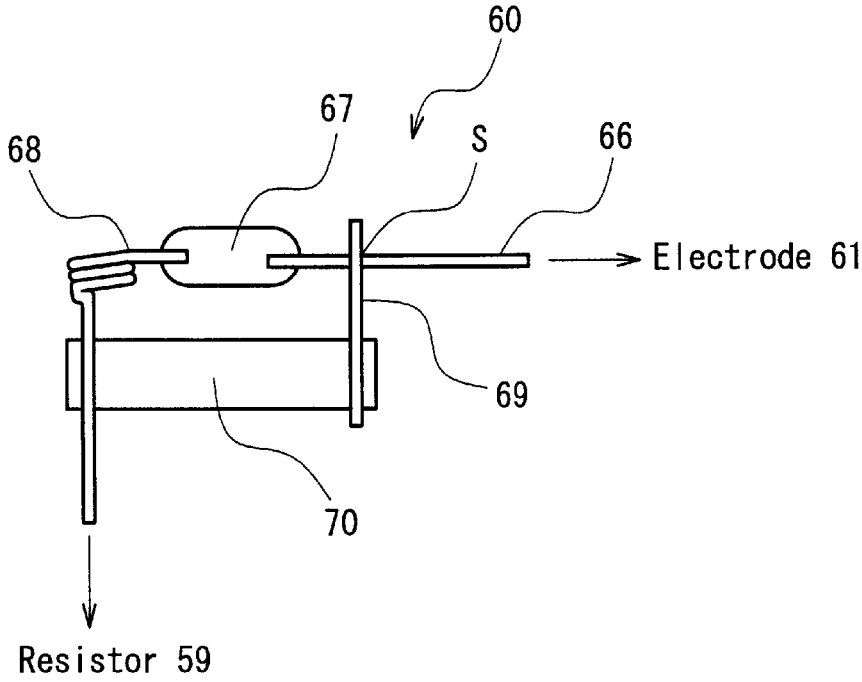
FIG. 7 (PRIOR ART)
FIG. 7 illustrates a thermally-actuated switch used for the lighting circuit.
Figure 8:
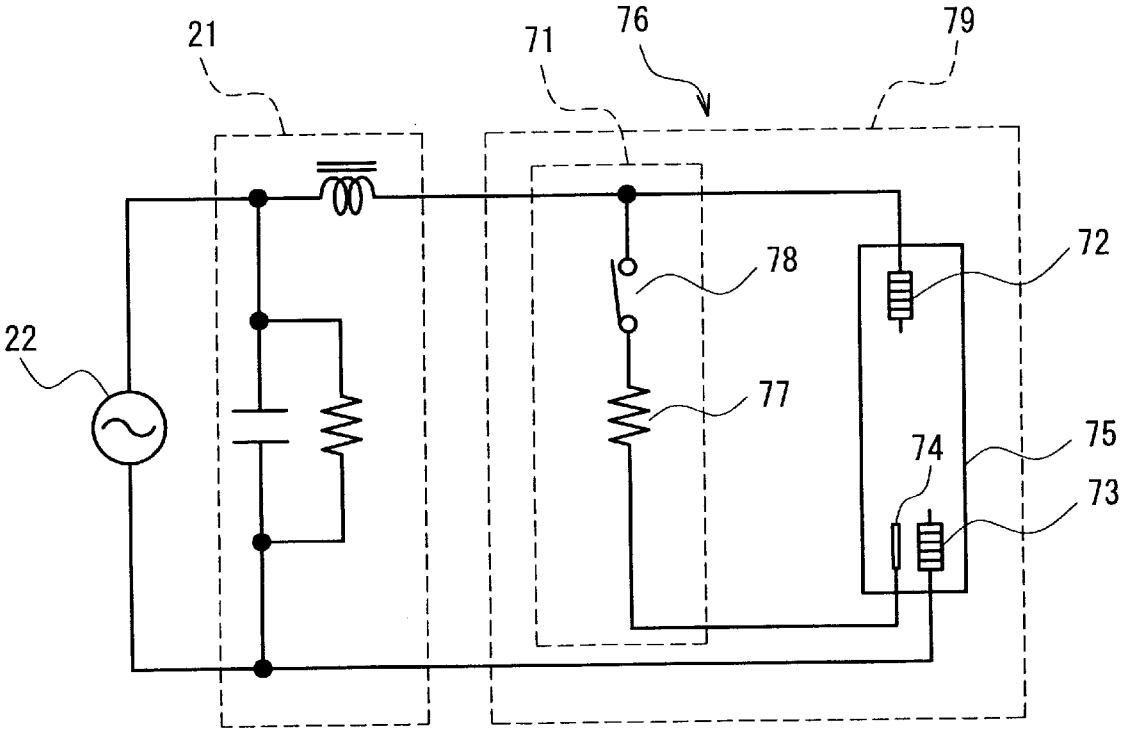
FIG. 8 (PRIOR ART)
FIG. 8 illustrates another lighting circuit of a conventional high-intensity discharge lamp.

A metal halide lamp in a third embodiment of the present invention is described below by referring to FIG. 5. An arc tube 49 composing a metal halide lamp 48 is made of quartz. At both the ends of the arc tube 49 are sealed a pair of main electrodes 50, 51 made of tungsten and an auxiliary electrode 52 provided adjacent to the main electrode 51. Inside the arc tube 49, a metal halide (NaI+TlI+InI) as a luminescent material, mercury (Hg) as a buffer gas, and a neon-argon penning gas (Ne+0.5% Ar) of about 10 kPa for aiding start are filled respectively.

A starting circuit 53 comprises a resistor 54 for restricting current and a thermally-actuated switch 55 for disconnecting the starting circuit, which are connected in series. The remaining terminal of the thermally-actuated switch 55 is connected to the main electrode 50 while the remaining terminal of the resistor 54 is connected to the auxiliary electrode 52. The thermally-actuated switch 55 used in this embodiment is the same as those described in the first and second embodiment.

The arc tube 49 and the starting circuit 53 are provided to the interior of an outer tube 56 in which a gas comprised of a mixture of nitrogen and neon ($N_2$+60% Ne) at a pressure of about 53 kPa is filled.

The metal halide lamp 48 is lighted in the following manner. When a supply voltage 22 is applied, auxiliary discharge occurs between the electrode 51 and the auxiliary electrode 52. Next, main discharge starts between the main electrodes 50 and 51 due to the action of a sufficient amount of initial electrons supplied from the auxiliary discharge and the neon-argon penning gas for aiding the start. About two minutes after the starting of the main discharge, the thermally-actuated switch 55 shifts from a closed state to an open state instantaneously due to the heat from the arc tube 49, and the starting circuit 53 is separated from the lighting circuit. Subsequently, the thermally-actuated switch 55 maintains its open state during a steady lighting state of the lamp due to the heat from the arc tube 49. Similar to the first and second embodiments, a spacing between the contact of the fixed electrode member and the contact of the movable electrode member was about 0.6 mm when the thermally-actuated switch 55 was in an open state.

In a lighting test for the metal halide lamp of this embodiment, no arc discharge occurred between the contacts of the thermally-actuated switch 55 in an open state even when a filler gas such as sodium and xenon was leaked from the arc tube 49 into the outer tube 56 at a break-off just after the starting or at the end of the lamp's life. It was confirmed also that no sustained arc discharge was induced in a spacing between the remaining leads.

Since this starting circuit 53 has no switching function for inducing a high voltage pulse, no arc discharge will occur between the contacts of the thermally-actuated switch 55 even in case of a starting failure of the arc tube 49.

As mentioned above, the present invention provides a high-intensity discharge lamp with high safety, which can avoid sustained arc discharge between leads or the like inside an outer tube, when such arc discharge would be induced by arc discharge between contacts of a thermally-actuated switch in case of a starting failure or a break-off of an arc tube at the end of the lamp's life.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, all changes that come within the meaning and range of equivalency of the claims are intended to be embraced therein.

What is claimed is:

1. A high-intensity discharge lamp with a built-in starter, comprising an arc tube comprising a pair of main electrodes, a starting circuit having a thermally-actuated switch with contacts for disconnecting the starting circuit, and an outer tube for containing the arc tube and the starting circuit, the lamp being configured to be lighted up by a reactance ballast, wherein the thermally-actuated switch comprises an envelope bulb that covers the contacts of the thermally-actuated switch.

2. The high-intensity discharge lamp according to claim 1, wherein the thermally-actuated switch is of a snap-action type.

3. The high-intensity discharge lamp according to claim 1, wherein the thermally-actuated switch is configured to keep a spacing between the contacts in an open state of at least 0.3 mm.

4. The high-intensity discharge lamp according to claim 1, wherein the arc tube comprises an auxiliary electrode, the starting circuit comprises a series circuit of a glow starter, a first resistor and the thermally-actuated switch, the series circuit being connected in parallel to the arc tube, and a second resistor having one terminal connected to a node between the thermally-actuated switch and the first resistor while the other terminal is connected to the auxiliary electrode, where the first resistor and the thermally-actuated switch are arranged adjacent to each other.

5. The high-intensity discharge lamp according to claim 1, further comprising a start-aiding conductor to be supplied with voltage via a capacitor and arranged along the axial direction of the arc tube, wherein the starting circuit comprises a series circuit of a nonlinear ceramic capacitor having a switching function for interrupting current, a tungsten filament resistor for restricting current and the thermally-actuated switch, the series circuit being connected in parallel to the arc tube, and a heating resistor that is connected in parallel to the tungsten filament resistor and to the nonlinear ceramic capacitor and arranged in the vicinity of the nonlinear ceramic capacitor.

6. The high-intensity discharge lamp according to claim 1, wherein the arc tube comprises an auxiliary electrode, the starting circuit comprises a resistor and the thermally-actuated switch that are connected in series, and a remaining terminal of the thermally-actuated switch is connected to a main electrode while a remaining terminal of the resistor is connected to the auxiliary electrode.

* * * * *